US009312648B2

(12) United States Patent
Yudate

(10) Patent No.: US 9,312,648 B2
(45) Date of Patent: Apr. 12, 2016

(54) MULTIPOLAR SINGLE-HEAD PLUG AND METHOD FOR MANUFACTURING SAME

(71) Applicant: EX COMPANY LIMITED, Matsuyama-shi, Ehime (JP)

(72) Inventor: Shinya Yudate, Matsuyama (JP)

(73) Assignee: EX COMPANY LIMITED, Matsuyama-shi, Ehime (JP)

( * ) Notice: Subject to any disclaimer, the term of this patent is extended or adjusted under 35 U.S.C. 154(b) by 224 days.

(21) Appl. No.: 14/350,982

(22) PCT Filed: Oct. 5, 2012

(86) PCT No.: PCT/JP2012/006412

§ 371 (c)(1),
(2) Date: Apr. 10, 2014

(87) PCT Pub. No.: WO2013/061521

PCT Pub. Date: May 2, 2013

(65) Prior Publication Data

US 2014/0308854 A1 Oct. 16, 2014

(30) Foreign Application Priority Data

Oct. 26, 2011 (JP) ..... 2011-235478

(51) Int. Cl.

| | |
|---|---|
| ***H01R 24/58*** | (2011.01) |
| ***H01R 13/405*** | (2006.01) |
| ***H01R 43/24*** | (2006.01) |
| *H01R 107/00* | (2006.01) |

(52) U.S. Cl.

CPC ..... *H01R 24/58* (2013.01); *H01R 13/405* (2013.01); *H01R 43/24* (2013.01); *H01R 2107/00* (2013.01)

(58) Field of Classification Search

CPC .. H01R 13/405; H01R 2107/00; H01R 43/24; H01R 24/58

USPC ..... 439/669, 668, 675, 851, 578, 750, 889

See application file for complete search history.

(56) References Cited

U.S. PATENT DOCUMENTS

| | | | | |
|---|---|---|---|---|
| 7,553,195 | B2 * | 6/2009 | Matsumoto | H01R 13/5045 439/669 |
| 7,824,228 | B1 * | 11/2010 | Yang | H01R 13/41 439/668 |
| 7,950,967 | B2 * | 5/2011 | Stiehl | H01R 24/58 439/669 |
| 2010/0279553 | A1 | 11/2010 | Izumi | |

FOREIGN PATENT DOCUMENTS

| | | | |
|---|---|---|---|
| JP | 10-199631 | A | 7/1998 |
| JP | 2010-049838 | A | 3/2010 |
| WO | 2009/091495 | A2 | 7/2009 |

OTHER PUBLICATIONS

International Search Report for PCT/JP2012/006412, Mailing Date of Jan. 8, 2013.

* cited by examiner

*Primary Examiner* — Edwin A. Leon

(74) *Attorney, Agent, or Firm* — Westerman, Hattori, Daniels & Adrian, LLP

(57) ABSTRACT

A multipolar single-head plug having a bar electrode exposed at a tip thereof, tubular electrodes concentrically arranged on an outer circumference of the bar electrode and exposed at the outer circumference on a side closer to a root than the exposed part of the bar electrode at the tip and an insulator composed of a first insulating part, and second insulating parts. A middle section of at least one of the insulating parts is provided with an insulating material such as an electrodeposition coating part or an insulating tube separate from the insulating resin for insert molding. The separate insulating material is provided so as to cover a given area of the outer circumference of the bar electrode or a given area of an outer circumference of the tubular electrode.

19 Claims, 8 Drawing Sheets

(a)

(b)

(c)

MULTIPOLAR SINGLE-HEAD PLUG AND METHOD FOR MANUFACTURING SAME

TECHNICAL FIELD

This invention relates to a multipolar single-head plug to be used for electrical connection of various electronic devices such as multifunctional portable phones and potable music players, and a method for manufacturing the plug.

BACKGROUND ART

A multipolar single-head plug and a corresponding multipolar jack have conventionally been used for electrical connection of various electronic devices. As an example, a connector is composed of a multipolar single-head plug provided to a peripheral electronic device such as a headphone and a multipolar jack provided to the body of an electronic device such as a multifunctional portable phone or a portable music player.

This multipolar single-head plug has a core bar to be inserted in the multipolar jack. The core bar is given a bar electrode exposed at a tip and one or multiple tubular electrodes exposed at an outer circumference on a side closer to a root than the bar electrode. An insulating part intervenes between the bar electrode and the tubular electrode. If there are multiple tubular electrodes, the insulating part intervenes between these tubular electrodes. As a result, properties of insulation between the electrodes are maintained. The multipolar single-head plug is generally formed to be in conformity with or compatible with standards relating to single-head plugs and jacks defined in Japanese Industrial Standards or standards of Japan Electronics and Information Technology Industries Association (see patent literature 1).

CITATION LIST

Patent Literature

Patent Literature 1: Japanese Patent Application Publication No. 2010-49838

SUMMARY OF INVENTION

Technical Problem

The aforementioned multipolar single-head plug is formed by insert molding realized as follows: the bar electrode and the tubular electrode are held at insert positions separated by a certain distance in a mold, an insulating resin is poured into the mold to form the insulating part made of the insulating resin between the bar electrode and the tubular electrode or between the tubular electrodes, and the bar electrode, the tubular electrode, and the insulating part are integrated with the insulating resin.

Meanwhile, increase of the number of poles such as four or five of a multipolar plug narrows a flow path for the insulating resin between the bar electrode and the tubular electrode or a flow path for the insulating resin between the tubular electrodes, thereby increasing pressure applied during pouring of the insulating resin. This increase of the pressure applied during pouring of the insulating resin makes the bar electrode or the tubular electrode eccentric. This places an obstacle to formation of an insulating part of a given shape formed by pouring the insulating resin smoothly between the bar electrode and the tubular electrode or between the tubular electrodes. As a result, a short-circuit between electrodes occurs in more multipolar single-head plugs during a pressure test or an energizing test, causing the problem of yield reduction.

Hence, a multipolar single-head plug has been requested that can reliably encourage maintenance of the properties of insulation between electrodes and prevention of a short-circuit between electrodes and can enhance yield even if the plug has a large number of poles.

This invention has been suggested in view of the aforementioned problems. An object of this invention is to provide a multipolar single-head plug that can reliably encourage maintenance of the properties of insulation between electrodes and prevention of a short-circuit between electrodes and can enhance yield significantly even if the plug has a large number of poles, and a method for manufacturing the plug.

Solution to Problem

A multipolar single-head plug of this invention comprises: a bar electrode exposed at a tip thereof; multiple curved electrodes provided separately at given positions of an outer circumference of the bar electrode, the curved electrodes being exposed at the outer circumference on a side closer to a root than the exposed part of the bar electrode at the tip; and an insulator composed of an insulating part between the bar electrode and the curved electrode and an insulating part between the curved electrodes. The multipolar single-head plug is integrated with an insulating resin for insert molding that forms part of the insulator.

At least one of the insulating parts is composed of a front section, a middle section and a rear section. The middle section is separate from the front and rear sections and is provided with an insulating material separate from the insulating resin for insert molding. The separate insulating material is provided so as to cover at least a given area of the outer circumference of the bar electrode or a given area of an outer circumference of one of the curved electrodes.

According to this structure, the middle section of the insulating part is provided with the separate insulating material. This can reliably achieve insulation in this section irrespective of the condition of filling with the insulating resin during insert molding. Meanwhile, the insulating resin may be made thicker by expanding a resin flow path corresponding to a middle section in narrow space of a different insulating part, or a separate insulating material may also be provided in a part corresponding to this resin flow path. In either case, insulation can be achieved reliably even in narrow space such as a middle section of the different insulating part. Thus, even with a large number of poles, the multipolar single-head plug can reliably encourage maintenance of the properties of insulation between electrodes and prevention of a short-circuit between electrodes, so that the yield of the multipolar single-head plug can be enhanced significantly.

In the multipolar single-head plug of this invention, the curved electrodes are tubular electrodes, and the tubular electrodes are concentrically arranged on the outer circumference of the bar electrode. Specifically, the multipolar single-head plug of this invention comprises: a bar electrode exposed at a tip thereof; multiple tubular electrodes concentrically arranged on an outer circumference of the bar electrode and exposed at the outer circumference on a side closer to a root than the exposed part of the bar electrode at the tip; and an insulator composed of an insulating part between the bar electrode and the tubular electrode and an insulating part between the tubular electrodes. The multipolar single-head plug is integrated with an insulating resin for insert molding that forms part of the insulator. A middle section of at least one of the insulating parts is provided with an insulating material separate from the insulating resin for insert molding. The separate insulating material is provided so as to cover at least a given area of the outer circumference of the bar electrode or a given area of an outer circumference of one of the tubular electrodes.

According to this structure, the middle section of the insulating part is provided with the separate insulating material. This can reliably achieve insulation in this section irrespective of the condition of filling with the insulating resin during insert molding. Meanwhile, the insulating resin may be made thicker by expanding a resin flow path corresponding to a middle section in narrow space of a different insulating part, or a separate insulating material may also be provided in a part corresponding to this resin flow path. In either case, insulation can be achieved reliably even in narrow space such as a middle section of the different insulating part. Thus, even with a large number of poles, the multipolar single-head plug including the bar electrode and the tubular electrodes can reliably encourage maintenance of the properties of insulation between electrodes and prevention of a short-circuit between electrodes, so that the yield of the multipolar single-head plug can be enhanced significantly.

In the multipolar single-head plug of this invention, the separate insulating material is an insulating material of a cylindrical shape, and the separate insulating material of the cylindrical shape is provided to be responsive to a cylindrical narrow path extending axially between the bar electrode and the tubular electrode or between the tubular electrodes.

According to this structure, an area where the separate insulating material is to be formed can be limited to the minimum necessary area: a narrow path of the insulating part. This structure can simplify the cylindrical shape of the separate insulating material, making it possible to encourage reduction of manufacturing cost and efficient manufacturing process. Additionally, where areas requiring insulation of concentric narrow paths are provided between the bar electrode and the tubular electrode and between the tubular electrodes, use of the cylindrical insulating material can adjust the thickness of each insulating part easily.

In the multipolar single-head plug of this invention, an insulating part having the middle section provided with the separate insulating material has a front section composed of an insulating collar.

According to this structure, providing the insulating collar as a front section of the insulating part eliminates the need for providing an inlet for the insulating resin for insert molding in response to the front section of the insulating part or the need for providing multiple inlets. This enables use of existing facilities as they are to allow reduction of manufacturing cost.

In the multipolar single-head plug of this invention, the separate insulating material and the insulating collar are provided so as to form engagement therebetween.

This structure makes tight contact between the separate insulating material and the insulating collar reliably, so that insulation properties can be maintained more reliably.

In the multipolar single-head plug of this invention, the separate insulating material is an electrodeposition coating part.

According to this structure, forming the separate insulating material by electrodeposition coating allows the separate insulating material to be more uniform in thickness. This can encourage uniform insulation and enhanced stability. This can also enhance resistance to pressure of the separate insulating material. This can further control formation of the separate insulating material freely in a desired area, so that the separate insulating material can be formed in an area given a higher degree of freedom.

In the multipolar single-head plug of this invention, the separate insulating material is an insulating tube.

According to this structure, using the insulating tube as the separate insulating material can place the separate insulating material easily on an electrode surface and can control the thickness of the separate insulating material easily. Further, general-purpose tubes can be used as the separate insulating material, making it possible to encourage reduction of manufacturing cost and efficient manufacturing process for the separate insulating material.

In the multipolar single-head plug of this invention, the insulator comprises: an insulating part having the middle section provided with the separate insulating material; and an insulating part entirely made of the insulating resin for insert molding.

According to this structure, the separate insulating material can reliably achieve insulation in the middle section irrespective of the condition of filling with the insulating resin during insert molding. Further, in the insulating part entirely made of the insulating resin for insert molding, the insulating resin can be made thicker by expanding a resin flow path corresponding to a middle section in narrow space of this insulating part, thereby achieving insulation reliably. Additionally, the number of steps for forming the separate insulating material such as the number of electrodeposition coating steps or the number of steps for assembling the insulating tube can be minimized, making it possible to encourage efficient manufacturing steps and reduction of manufacturing cost.

In the multipolar single-head plug of this invention, multiple insulating parts have the middle sections provided with the separate insulating materials. The multiple insulating parts intervene between the insulating part between the bar electrode and the tubular electrode and the outermost insulating part between the tubular electrodes, Each of the multiple insulating parts intervenes between the tubular electrodes.

According to this structure, the separate insulating materials are provided to the insulating parts between the outermost side and the innermost side where eccentricity of the tubular electrode might be more influential due to a narrower flow path for the insulating resin. Accordingly, even with a large number of poles, the multipolar single-head plug can more reliably encourage maintenance of the properties of insulation between electrodes and prevention of a short-circuit between electrodes, so that the yield of the multipolar single-head plug can be enhanced more significantly.

In the multipolar single-head plug of this invention, each of the insulating parts forming the insulator has the middle section provided with the separate insulating material.

According to this structure, pouring of the insulating resin or favorable insulation will not be disturbed by eccentricity of an electrode due to increase of pressure applied during pouring of the insulating resin, so that the separate insulating material can reliably achieve insulation in a middle section in narrow space of each of the insulating parts. This can enhance yield further.

In the multipolar single-head plug of this invention, the separate insulating material has a thickness of from 0.008 to 0.15 mm.

According to this structure, the thickness of the separate insulating material formed by electrodeposition coating or that of the insulating tube formed as the separate insulating material is determined to be within a predetermined range. Hence, even if the multipolar single-head plug has a large number of poles such as four, five or more, the minimum required thickness of the insulating part can be assured to achieve insulation reliably at a middle section. Meanwhile, the insulating part is prevented from increasing excessively in thickness, so that compatibility can be maintained reliably with standards relating to single-head plugs and lacks defined in Japanese Industrial Standards or standards of Japan Electronics and information Technology Industries Association. The separate insulating material having the aforementioned thickness may not be applied if insert molding with the insulating resin works satisfactorily, and can be applied only to the case where a middle section is to have a thickness that is likely to cause an insufficient condition of insert molding with the insulating resin or a smaller thickness. This can reliably achieve effects relating to reduction of manufacturing cost and efficient manufacturing process.

According to a method for manufacturing a multipolar single-head plug of this invention is a method for manufacturing a multipolar single-head plug that comprises: a bar electrode exposed at a tip thereof; multiple tubular electrodes concentrically arranged on an outer circumference of the bar electrode and exposed at the outer circumference on a side closer to a root than the exposed part of the bar electrode at the tip; and an insulator composed of an insulating part between the bar electrode and the tubular electrode and an insulating part between the tubular electrodes. The multipolar single-head plug is integrated with an insulating resin for insert molding that forms part of the insulator. The method comprises: a first step of providing an insulating material so as to cover at least a given area of the outer circumference of the bar electrode or a given area of an outer circumference of one of the tubular electrodes, the insulatin g material being provided to a middle section of at least one of the insulating parts composed of a front section, the middle section, and a rear section, the middle section being separate from the front and rear sections, the insulating material being separate from the insulating resin for insert molding; a second step of placing the bar electrode and the multiple tubular electrodes in a mold; and a third step of forming the insulator including an insulating part with the insulating resin tightly contacting the separate insulating material by pouring the insulating resin into the mold, thereby integrating the bar electrode, the multiple tubular electrodes, and the insulator.

According to this structure, the middle section of the insulating part is provided with the separate insulating material. This can reliably achieve insulation in this section irrespective of the condition of filling with the insulating resin during insert molding. Meanwhile, the insulating resin may be made thicker by expanding a resin flow path corresponding to a middle section in narrow space of a different insulating part, or a separate insulating material may also be provided in a part corresponding to this resin flow path. In either case, insulation can be achieved reliably even in narrow space such as a middle section of the different insulating part. Thus, even with a large number of poles, the multipolar single-head plug can reliably encourage maintenance of the properties of insulation between electrodes and prevention of a short-circuit between electrodes, so that the yield of the multipolar single-head plug can be enhanced significantly. Further, an electrode with the separate insulating material is placed in the mold and then the insulating resin is poured. This can integrate the separate insulating material easily and firmly as part of the insulator.

In the method for manufacturing the multipolar single-head plug of this invention, the first step includes a step of forming an electrodeposition coating part as the separate insulating material by performing electrodeposition coating so as to cover at least a given area of an outer circumference of one of the tubular electrodes, and the first step includes a step of fitting an insulating collar so as to form abutting contact with a side surface of an exposed part at the outer circumference of the tubular electrode provided with the separate insulating material.

According to this structure, a given area of an electrode can be covered reliably by electrodeposition coating, the insulating collar can be arranged at a given position reliably, and tight contact can be formed reliably between the insulating collar and the separate insulating material formed by electrodeposition coating.

In the method for manufacturing the multipolar single-head plug of this invention, the first step includes a step of fitting an insulating collar so as to form abutting contact with a side surface of an exposed part at an outer circumference of at least one of the tubular electrodes, and the first step includes a step of fitting an insulating tube so as to form engagement with the insulating collar and so as to cover a given area of the outer circumference of the tubular electrode.

According to this structure, a given area of an electrode can be covered reliably by the insulating tube, the insulating collar can be arranged at a given position reliably, and tight contact can be formed reliably between the insulating collar and the insulating tube.

An electronic device of this invention comprises the multipolar single-head plug of this invention.

This structure can provide an electronic device such as a peripheral electronic device that achieves the effects of the multipolar single-head plug of this invention.

ADVANTAGEOUS EFFECTS OF INVENTION

According to this invention, even with a large number of poles, the multipolar single-head plug can reliably encourage maintenance of the properties of insulation between electrodes and prevention of a short-circuit between electrodes, so that the yield of the multipolar single-head plug can be enhanced significantly.

DESCRIPTION OF EMBODIMENTS

[Multipolar Single-head Plug and Method for Manufacturing Same of First Embodiment]

The following describes a multipolar single-head plug 1 and a method for manufacturing the same according to a first embodiment of this invention.

Figure 1:
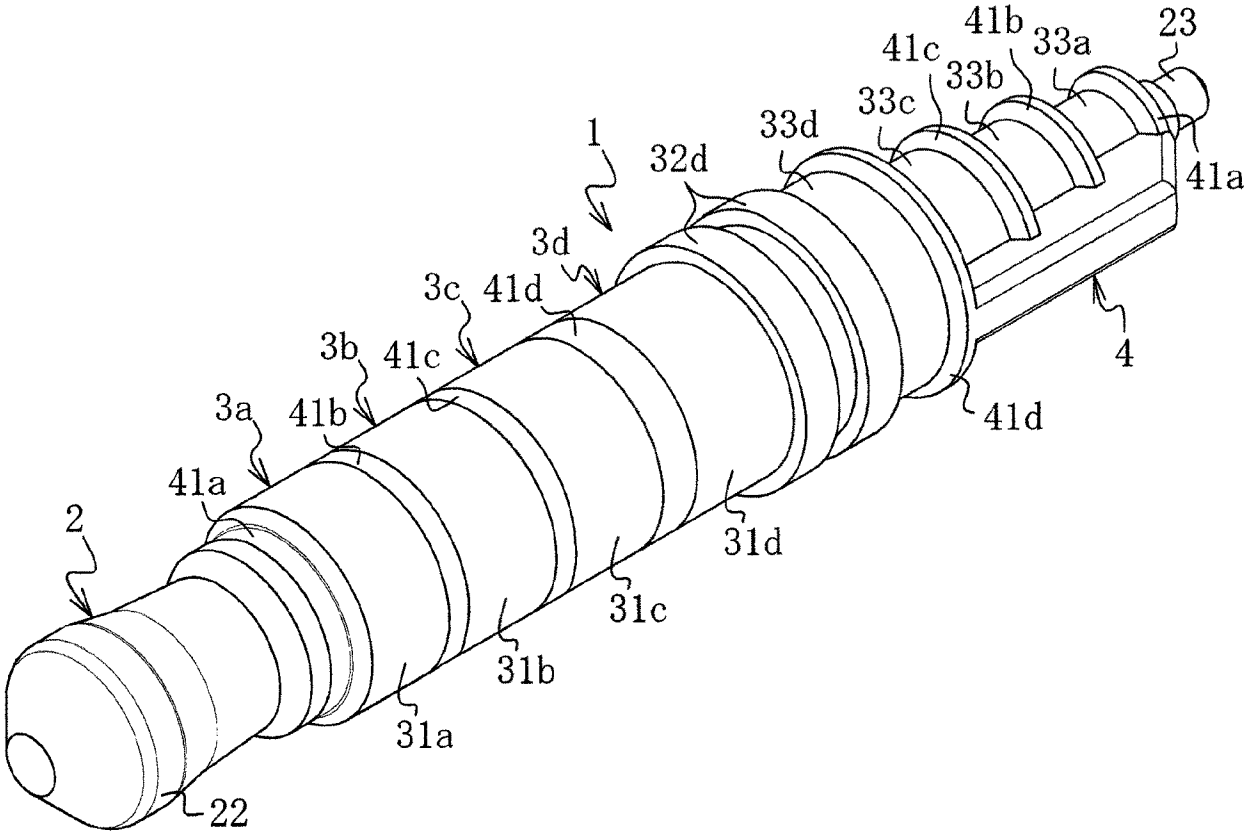
FIG. 1 is a perspective view of a multipolar single-head plug of a first embodiment.
Figure 2:
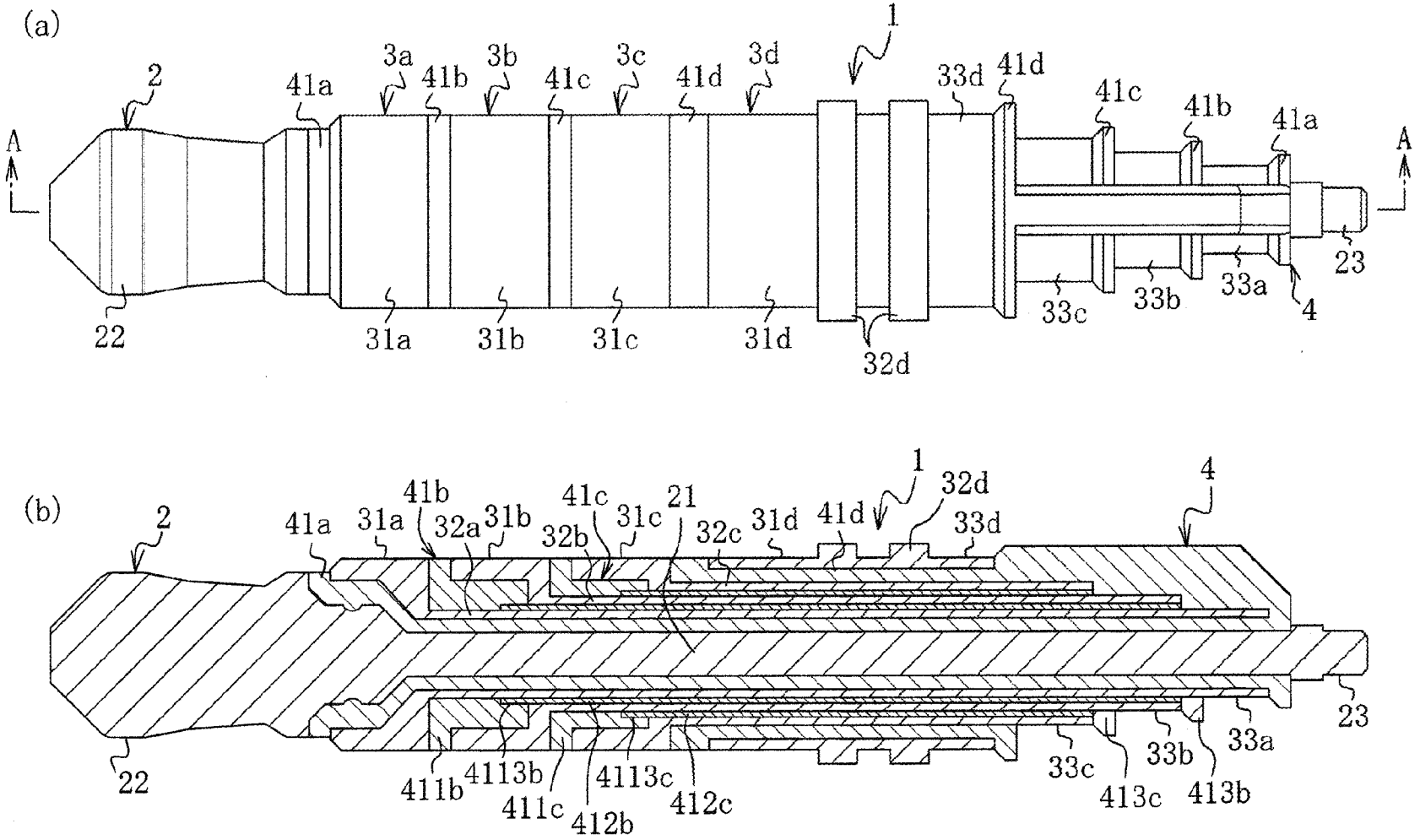
FIG. 2(*a*) is a front view of the multipolar single-head plug of the first embodiment and FIG. 2(*b*) is a sectional view taken along line A-A of FIG. 2(*a*).

As shown in FIGS. 1 and 2, the multipolar single-head plug 1 of the first embodiment is a five-pole single-head plug and is formed to be compatible with standards relating to poles of from two poles to four poles of single-head plugs and jacks defined in Japanese Industrial Standards or standards of Japan Electronics and Information Technology Industries Association. The multipolar single-head plug 1 is used in electronic devices including multifunctional portable phones and peripheral electronic devices such as headphones for portable music players, for example.

The multipolar single-head plug 1 has a bar electrode 2 made of conductive metal. The bar electrode 2 is composed of a shaft part 21, a conductive contact part 22 larger in diameter than the shaft part 21 and exposed at a tip, and a lead part 23 provided behind the shaft part 21. Tubular electrodes 3*a* to 3*d* are concentrically arranged on the outer circumference of the bar electrode 2. In the first embodiment, four tubular electrodes including first to fourth tubular electrodes 3*a* to 3*d* are provided and each of these electrodes is made of conductive metal. The bar electrode 2 and the tubular electrodes 3*a* to 3*d* are formed to have lengths that sequentially decrease in the order named so as to reliably form conductive contact parts 22 and 31*a* to 31*d* and lead parts 23 and 33*a* to 33*d* described later.

The tubular electrodes 3*a* to 3*d* include the conductive contact parts 31*a* to 31*d* respectively exposed at outer circumferences corresponding to exposed parts at the outer circumferences that are provided on a side closer to a root than the conductive contact part 22 corresponding to an exposed part of the bar electrode 2 at the tip. The three tubular electrodes 3*a* to 3*c* placed inside include cylindrical base parts 32*a* to 32*c* respectively, the tubular conductive contact parts 31*a* to 31*c* respectively larger in diameter than the base parts 32*a* to 32*c* and provided at respective tips of the base parts 32*a* to 32*c*, and the lead parts 33*a* to 33*c* respectively provided behind the base parts 32*a* to 32*c* and exposed from an insulator 4 described later. The outermost tubular electrode 3*d* is given an externally projecting flange 32*d* provided at substantially the center of the tubular electrode 3*d*. A part in front of the flange 32*d* is the conductive contact part 31*d* and a part behind the flange 32*d* is the lead part 33*d*.

A part in front of the flange 32*d* is a part to be inserted in a jack. While this insertion part is inserted in the jack, the conductive contact parts 22 and 31*a* to 31*d* come into contact with corresponding conductive terminals of the jack to be electrically connected to these terminals. The lead parts 23 and 33*a* to 33*d* are to be connected to lead wires such as interconnects of a peripheral electronic device.

The bar electrode 2 and the tubular electrodes 3*a* to 3*d* are insulated from each other by the insulator 4 composed of insulating parts 41*a* to 41*d*. The insulating part 41*a* insulates the bar electrode 2 and the tubular electrode 3*a* from each other. The insulating part 41*b* insulates the tubular electrodes 3*a* and 3*b* from each other. The insulating part 41*c* insulates the tubular electrodes 3*b* and 3*c* from each other. The insulating part 41*d* insulates the tubular electrodes 3*c* and 3*d* from each other.

The insulating part 41*a* is provided so as to fill in a gap between the bar electrode 2 and the tubular electrode 3*a*. The insulating part 41*a* is entirely made of an insulating resin poured during insert molding.

The insulating part 41*b* is provided so as to fill in a gap between the tubular electrodes 3*a* and 3*b*. The insulating part 41*b* is composed of a insulating collar 411*b* provided at a front section, a cylindrical electrodeposition coating part 412*b* provided at a middle section and corresponding to an insulating material separate from the insulating resin for insert molding, and a insulating resin filled part 413*b* provided at a rear section. The electrodeposition coating part 412*b* is provided so as to cover a given area of the outer circumference of the tubular electrode 3*a*. The electrodeposition coating part 412*b* is provided to be responsive to a cylindrical narrow path extending axially between the tubular electrodes 3*a* and 3*b*. It is preferable that the electrodeposition coating part 412*b* have a thickness of from about 0.008 to about 0.15 mm and more preferably, from about 0.015 to about 0.1 mm.

Figure 3:
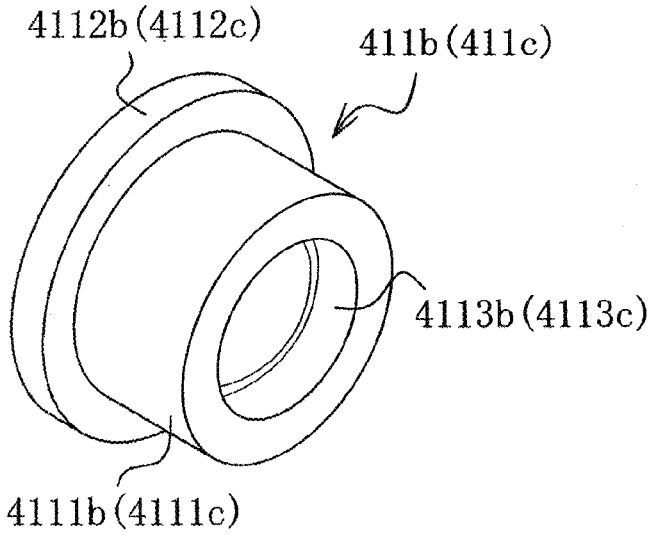
FIG. 3 is a perspective view of an insulating collar.

As shown in FIG. 3, the insulating collar 411*b* has a flange 4112*b* formed at a tip of a tubular part 4111*b*. A cut 4113*b* is formed in a rear inner circumferential surface of the tubular part 4111*b*. The electrodeposition coating part 412*b* is arranged such that a tip thereof fits in the cut 4113*b* of the insulating collar 411*b*. A rear end surface of the electrodeposition coating part 412*b* is provided so as to tightly contact the insulating resin filled part 413*b*.

The insulating part 41*c* is provided so as to fill in a gap between the tubular electrodes 3*b* and 3*c*. Like the insulating part 41*b*, the insulating part 41*c* is composed of a insulating collar 411*c* provided at a front section, a cylindrical electrodeposition coating part 412*c* provided at a middle section and corresponding to an insulating material separate from the insulating resin for insert molding, and a insulating resin filled part 413*c* provided at a rear section. The electrodeposition coating part 412*c* is provided so as to cover a given area of the outer circumference of the tubular electrode 3*b*. The electrodeposition coating part 412*c* is provided to be responsive to a cylindrical narrow path extending axially between the tubular electrodes 3*b* and 3*c*. It is preferable that the electrodeposition coating part 412*c* have a thickness of from about 0.008 to about 0.15 mm and more preferably, from about 0.015 to about 0.1 mm.

As shown in FIG. 3, the insulating collar 411*c* has a flange 4112*c* formed at a tip of a tubular part 4111*c*. A cut 4113*c* is formed in a rear inner circumferential surface of the tubular part 4111*c*. The electrodeposition coating part 412*c* is arranged such that a tip thereof fits in the cut 4113*c* of the insulating collar 411*c*. A rear end surface of the electrodeposition coating part 412*c* is provided so as to tightly contact the insulating resin filled part 413*c*.

The insulating part 41*d* is provided so as to fill in a gap between the tubular electrodes 3*c* and 3*d*. The insulating part 41*d* is entirely made of the insulating resin poured during insert molding. Specifically, the electrodeposition coating parts 412*b* and 412*c* as separate insulating materials are provided to the multiple insulating parts 41*b* and 41*c* respectively intervening between the insulating part 41*a* between the bar electrode 2 and the tubular electrode 3*a* and the outermost insulating part 41*d* between the tubular electrodes 3*c* and 3*d*, while intervening between the tubular electrodes 3*a* and 3*b* and between the tubular electrodes 3*b* and 3*c*.

The insulating parts 41*a* and 41*d* and the insulating resin filled parts 413*b* and 413*c* are formed integrally by pouring the insulating resin during insert molding. The insulating parts 41*a* to 41*d* are integrated with this insulating resin to form the insulator 4. Further, the bar electrode 2, the tubular electrodes 3*a* to 3*d*, and the insulator 4 are integrated with the insulating resin for insert molding forming part of the insulator 4, thereby forming the multipolar single-head plug 1.

Figure 4:
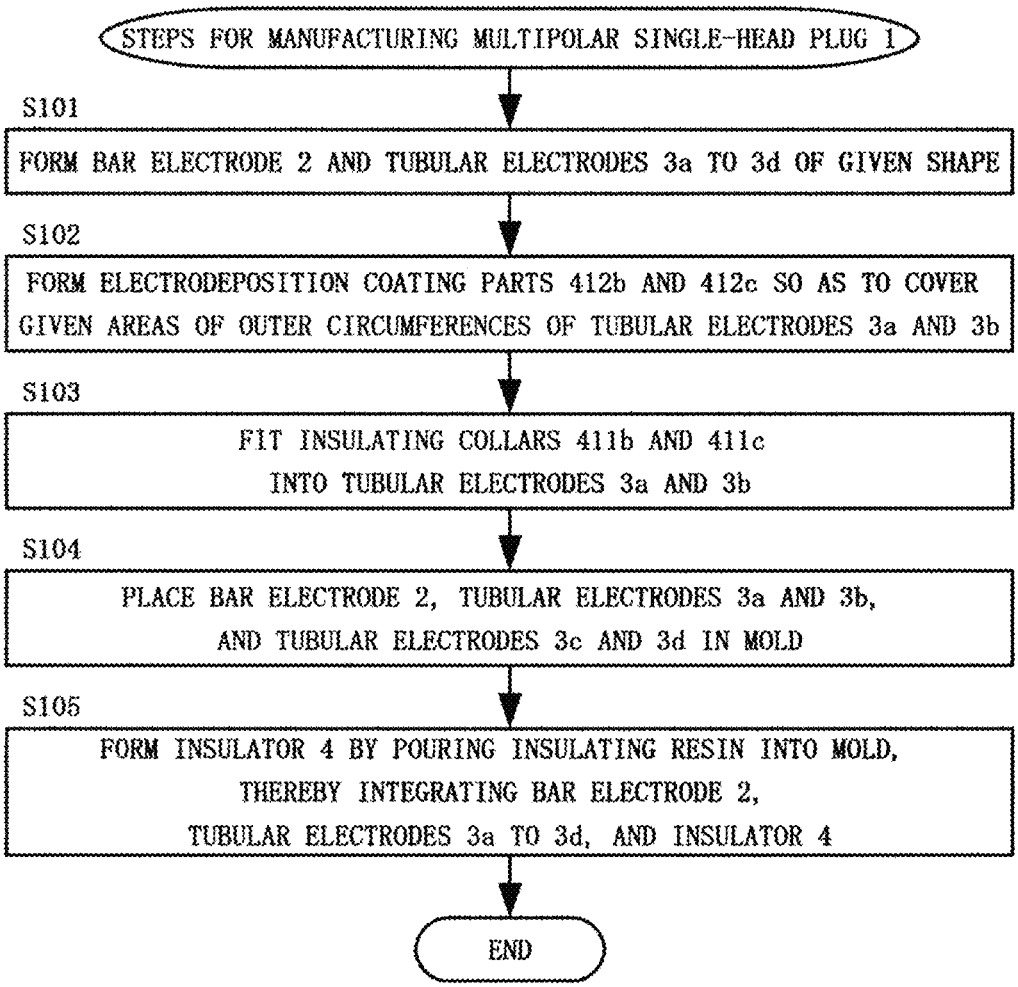
FIG. 4 is a flowchart showing steps for manufacturing the multipolar single-head plug of the first embodiment.
Figure 5:
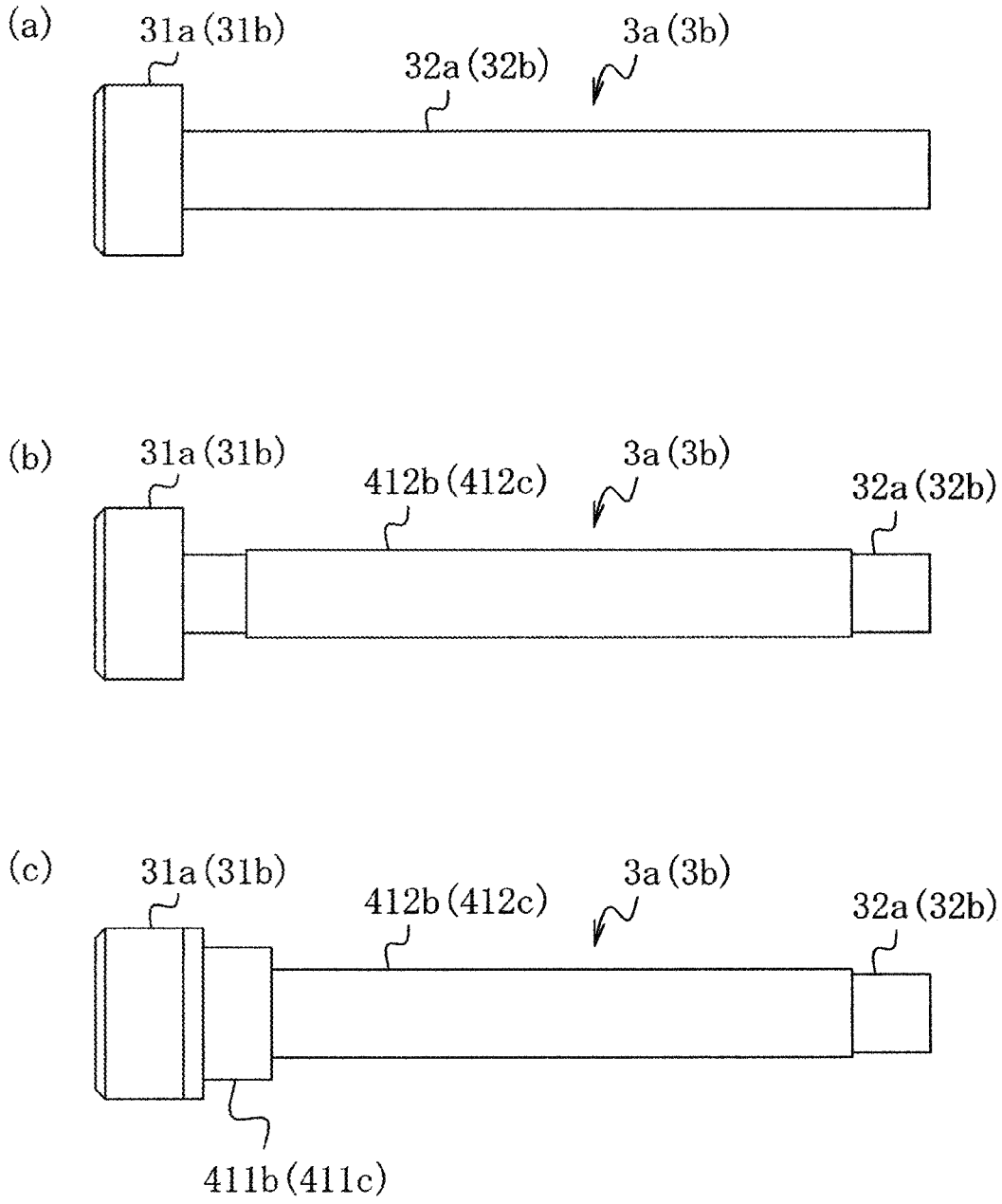
FIGS. 5(*a*) to 5(*c*) are explanatory views explaining electrodeposition coating on a tubular electrode and attachment of an insulating collar to the tubular electrode according to the first embodiment.

For manufacture of the multipolar single-head plug 1 of the first embodiment, as shown in FIG. 4, the bar electrode 2 and the tubular electrodes 3*a* to 3*d* each of a given shape are formed for example by cutting (S101). Next, as shown in FIGS. 4 and 5, electrodeposition coating is performed so as to cover given areas of the outer circumferences of the tubular electrodes 3*a* and 3*b*, thereby forming the electrodeposition coating parts 412*b* and 412*c* as separate insulating materials (S102). The electrodeposition coating parts 412*b* and 412*c* can be made of an appropriate insulating material such as polyamide resin or fluororesin that can be formed by electrodeposition coating.

Next, as shown in FIGS. 4 and 5, with the flanges 4112*b* and 4112*c* facing forward, the insulating collars 411*b* and 411*c* are fitted into the base parts 32*a* and 32*b* respectively from a side opposite the conductive contact parts 31*a* and 31*b* of the tubular electrodes 3*a* and 3*b*. The insulating collars 411*b* and 411*c* are inserted until the flanges 4112*b* and 4112*c* of the insulating collars 411*b* and 411*c* come into abutting contact with respective side surfaces of the conductive contact parts 31*a* and 31*b* (S103). The insulating collars 411*b* and 411*c* are made of an elastic material and are fitted onto the base parts 32*a* and 32*b* to predetermined positions while expanding in diameter. The fitted insulating collars 411*b* and 411*c* go into engagement at the cuts 4113*b* and 4113*c* with the respective tips of the electrodeposition coating parts 412*b* and 412*c*. The elastic material for the insulating collars 411*b* and 411*c* can be determined arbitrarily. Favorably, polyacetal (POM) or polypropylene (PP) can be used as such a material.

Next, as shown in FIG. 4, the bar electrode 2, the tubular electrodes 3*a* and 3*b* provided with the electrodeposition coating parts 412*b* and 412*c* and the insulating collars 411*b* and 411*c*, and the tubular electrodes 3*c* and 3*d* are placed in a mold (S104).

Then, the insulating resin is poured into the mold to perform insert molding. This forms the insulator 4 composed of the insulating parts 41*a* and 41*d*, and the insulating parts 41*b* and 41*c* with the electrodeposition coating parts 412*b* and 412*c* as separate insulating materials and the insulating resin tightly contacting the electrodeposition coating parts 412*b* and 412*c*. Then, the bar electrode 2, the multiple tubular electrodes 3*a* to 3*d*, and the insulator 4 are integrated (S105).

During this process, the insulating resin flows into an entire gap between the bar electrode 2 and the tubular electrode 3*a* and into an entire gap between the tubular electrodes 3*c* and 3*d*, and is then cured. This forms the insulating parts 41*a* and 41*d* entirely made of the insulating resin for insert molding. The insulating resin further flows so as to tightly contact respective rear end surfaces of the electrodeposition coating parts 412*b* and 412*c* in engagement with the insulating collars 411*b* and 411*c* and is then cured, thereby forming the insulating parts 41*b* and 41*c*. Then, the bar electrode 2, the tubular electrodes 3*a* to 3*d*, the insulating collars 411*b* and 411*c*, and the electrodeposition coating parts 412*b* and 412*c* are integrated with the insulating resin for insert molding.

According to the multipolar single-head plug 1 or the method for manufacturing the same, the respective middle sections of the insulating parts 41*b* and 41*c* are provided with the electrodeposition coating parts 412*b* and 412*c* as separate insulating materials. This can reliably achieve insulation in these sections irrespective of the condition of filling with the insulating resin during insert molding. Meanwhile, the insulating resin maybe made thicker by expanding a resin flow path corresponding to a middle section in narrow space of the different insulating part 41*a* or 41*d*, or a separate insulating material may also be provided in a part corresponding to this resin flow path. In either case, insulation can be achieved reliably even in narrow space such as a middle section of the different insulating part 41*a* or 41*d*. Thus, even with a large number of poles, the multipolar single-head plug 1 can reliably encourage maintenance of the properties of insulation between electrodes and prevention of a short-circuit between electrodes, so that the yield of the multipolar single-head plug 1 can be enhanced significantly.

These effects can be heightened by providing the electrodeposition coating parts 412*b* and 412*c* to the multiple insulating parts 41*b* and 41*c* between the bar electrode 2 and the outermost tubular electrode 3*d* where eccentricity of the tubular electrode 4*a*, 4*b* or 4*c* might be more influential due to a narrower flow path for the insulating resin.

As a result of the cylindrical shape of the electrodeposition coating parts 412*b* and 412*c*, areas where the electrodeposition coating parts 412*b* and 412*c* are to be formed can be limited to the minimum necessary areas: narrow paths of the insulating parts 41*b* and 41*c*. The cylindrical shape can simplify the shape of the electrodeposition coating parts 412*b* and 412*c*, making it possible to encourage reduction of manufacturing cost and efficient manufacturing process. Additionally, where areas requiring insulation of concentric narrow paths are provided between the bar electrode 2 and the tubular electrode 3*a*, between the tubular electrodes 3*a* and 3*b*, between the tubular electrodes 3*b* and 3*c*, and between the tubular electrodes 3*c* and 3*d*, use of the cylindrical electrodeposition coating parts 412*b* and 412*c* can adjust the thickness of each of the insulating parts 41*a* to 41*d* easily.

Providing the insulating collars 411*b* and 411*c* as respective front sections of the insulating parts 41*b* and 41*c* eliminates the need for providing an inlet for the insulating resin for insert molding in response to the front section of the insulating part 41*b* or 41*c* or the need for providing multiple inlets. This enables use of existing facilities as they are to allow reduction of manufacturing cost. Forming engagement of the electrodeposition coating parts 412*b* and 412*c* as separate insulating materials with the insulating collars 411*b* and 411*c* makes tight contact of the electrodeposition coating parts 412*b* and 412*c* with the insulating collars 411*b* and 411*c* reliably, so that insulation properties can be maintained more reliably.

Forming the electrodeposition coating parts 412*b* and 412*c* as separate insulating materials allows the separate insulating materials to be more uniform in thickness. This can encourage uniform insulation and enhanced safety. This can also enhance resistance to pressure. This can further control formation of a separate insulating material freely in a desired area, so that the separate insulating material can be formed in an area given a higher degree of freedom.

The insulator 4 is composed of the insulating parts 41*b* and 41*c* including the electrodeposition coating parts 412*b* and 412*c* as separate insulating materials formed at middle sections thereof, and the insulating parts 41*a* and 41*d* entirely made of the insulating resin for insert molding. This minimizes the number of electrodeposition coating steps, making it possible to encourage efficient manufacturing steps and reduction of manufacturing cost.

The thickness of the electrodeposition coating parts 412*b* and 412*c* as separate insulating materials is determined to be from 0.008 to 0.15 mm. Hence, even if the multipolar single-head plug 10 has a large number of poles such as four, five or more, the minimum required thickness of the insulating parts 41*b* and 41*c* can be ensured to achieve insulation reliably at middle sections. Meanwhile, the insulating parts 41*b* and 41*c* are prevented from increasing excessively in thickness, so that compatibility can be maintained reliably with standards relating to single-head plugs and jacks defined in Japanese Industrial Standards or standards of Japan Electronics and Information Technology Industries Association. The separate insulating material having the aforementioned thickness may not be applied if insert molding with the insulating resin works satisfactorily, and can be applied only to the case where a middle section is to have a thickness that is likely to cause an insufficient condition of insert molding with the insulating resin or a smaller thickness. This can reliably achieve effects relating to reduction of manufacturing cost and efficient manufacturing process.

The tubular electrodes 3*a* and 3*b* with the electrodeposition coating parts 412*b* and 412*c* are placed in the mold and then the insulating resin is poured. This can integrate the electrodeposition coating parts 412*b* and 412*c* easily and firmly as part of the insulator 4. Further, the electrodeposition coating parts 412*b* and 412*c* are provided to the tubular electrodes 3*a* and 3*b* and the insulating collars 411*b* and 411*c* are fitted so as to come into abutting contact with respective side surfaces of the conductive contact parts 31*a* and 31*b* of the tubular electrodes 3*a* and 3*b*. As a result, given areas of the tubular electrodes 3*a* and 3*b* can be covered reliably by electrodeposition coating, the insulating collars 411*b* and 411*c* can be arranged at given positions reliably, and tight contact of the insulating collars 411*b* and 411*c* can be formed reliably with the electrodeposition coating parts 412*b* and 412*c* respectively.

[Multipolar Single-head Plug and Method for Manufacturing Same of Second Embodiment]

The following describes a multipolar single-head plug 5 and a method for manufacturing the same according to a second embodiment of this invention.

Figure 6:
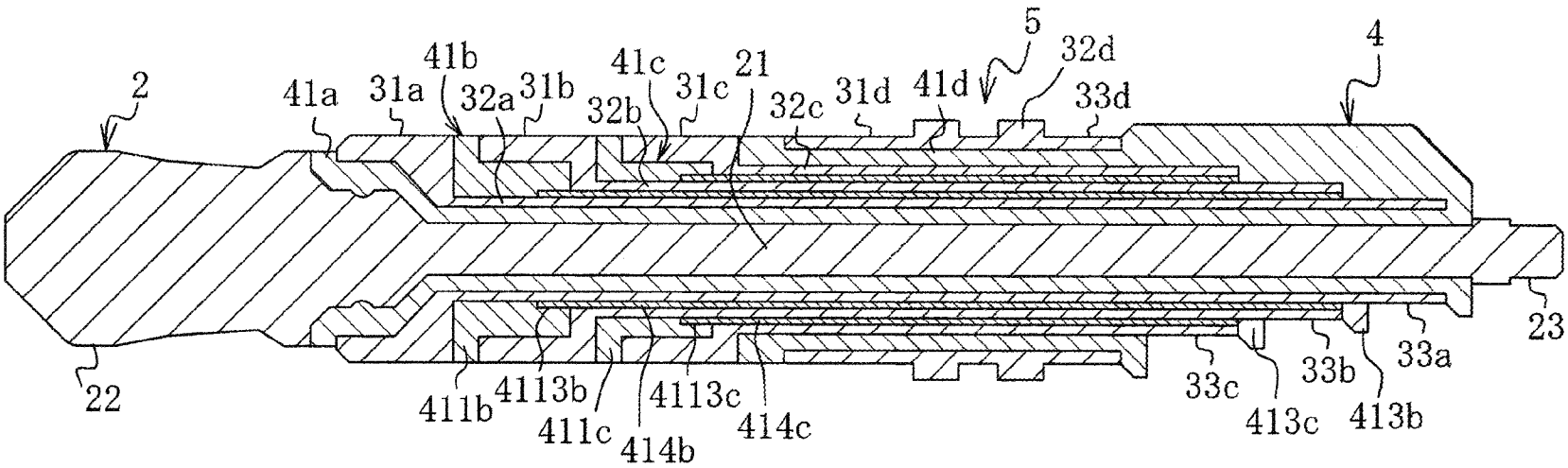
FIG. 6 is a sectional view of a multipolar single-head plug of a second embodiment corresponding to the cross section taken along line A-A.
Figure 7:
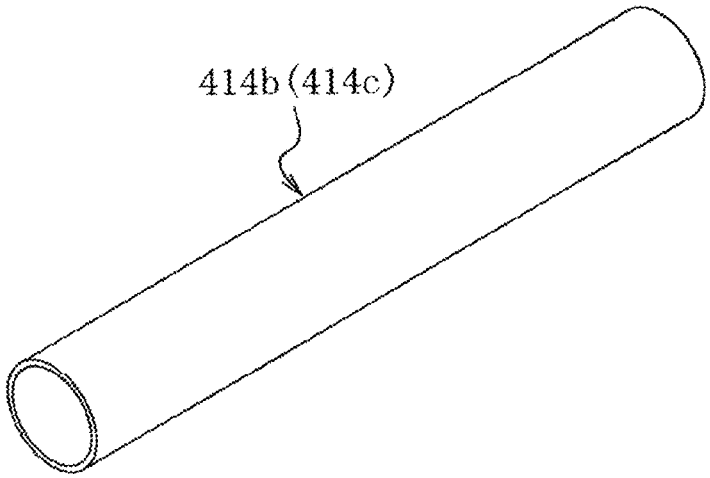
FIG. 7 is a perspective view of an insulating tube.

As shown in FIG. 6, the multipolar single-head plug 5 of the second embodiment basically has the same structure as that of the first embodiment. The multipolar single-head plug 5 includes a bar electrode 2, tubular electrodes 3*a* to 3*d*, and an insulator 4 composed of insulating parts 41*a* to 41*d* corresponding to those of the first embodiment. Meanwhile, unlike that of the first embodiment, the multipolar single-head plug 5 includes insulating tubes 414*b* and 414*c* as separate insulating materials instead of the electrodeposition coating parts 412*b* and 412*c* (see FIG. 7).

Specifically, the insulating part 41*b* provided so as to fill in a gap between the tubular electrodes 3*a* and 3*b* is composed of a insulating collar 411*b* provided at a front section, the cylindrical insulating tube 414*b* provided at a middle section and corresponding to an insulating material separate from an insulating resin for insert molding, and a insulating resin filled part 413*b* provided at a rear section. The insulating part 41*c* provided so as to fill in a gap between the tubular electrodes 3*b* and 3*c* is composed of a insulating collar 411*c* provided at a front section, the cylindrical insulating tube 414*c* provided at a middle section and corresponding to an insulating material separate from the insulating resin for insert molding, and a insulating resin filled part 413*c* provided at a rear section.

The insulating tubes 414*b* and 414*c* are provided so as to cover given areas of the outer circumferences of the tubular electrodes 3*a* and 3*b* respectively. The insulating tubes 414*b* and 414*c* are provided to be responsive to a cylindrical narrow path extending axially between the tubular electrodes 3*a* and 3*b* or between the tubular electrodes 3*b* and 3*c*. it is preferable that the insulating tubes 414*b* and 414*c* each have a thickness of from about 0.008 to about 0.15 mm and more preferably, from about 0.015 to about 0.1 mm. The insulating tubes 414*b* and 414*c* are arranged such that their tips fit in cuts 4113*b* and 4113*c* of the insulating collars 411*b* and 411*c* respectively. Respective rear end surfaces of the insulating tubes 414*b* and 414*c* are provided so as to tightly contact the insulating resin filled parts 413*b* and 413*c* respectively.

The insulating parts 41*a* and 41*d* and the insulating resin filled parts 413*b* and 413*c* are formed integrally with the insulating resin during insert molding, thereby integrating the insulating parts 41*a* to 41*d* to form the insulator 4. Further, the bar electrode 2, the tubular electrodes 3*a* to 3*d*, and the insulator 4 are integrated to form the multipolar single-head plug 5.

Figure 8:
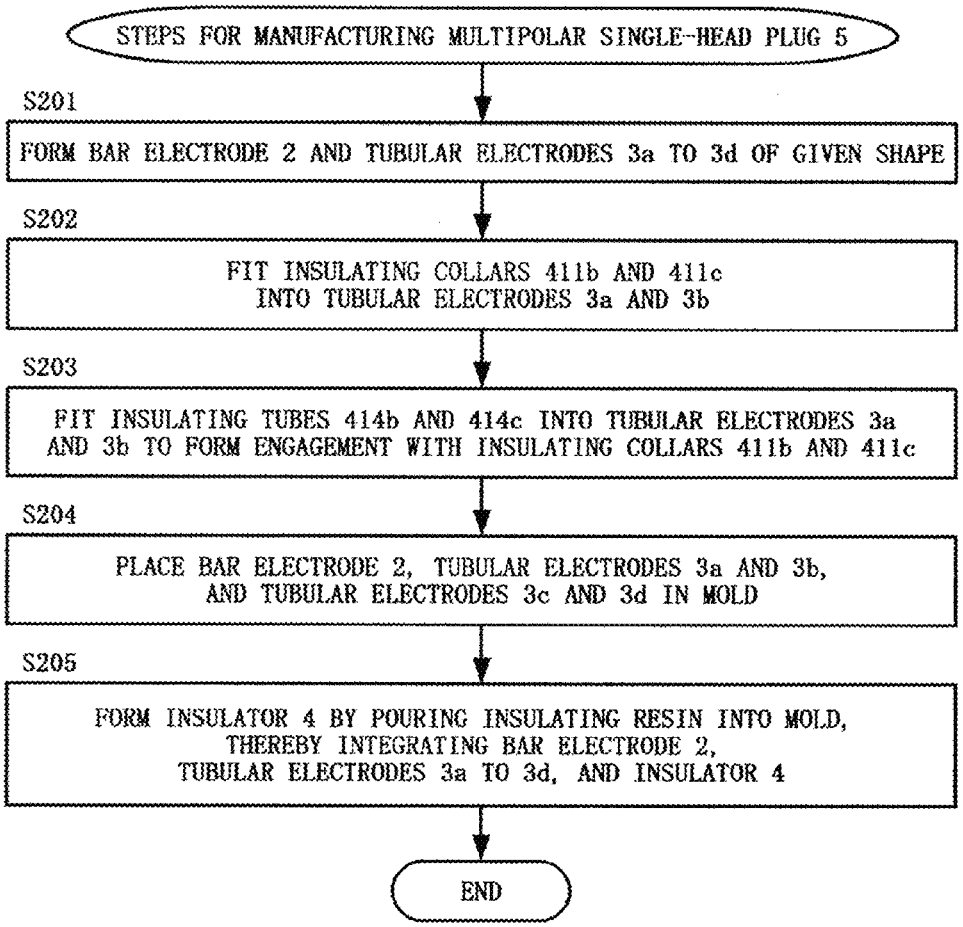
FIG. 8 is a flowchart showing steps for manufacturing the multipolar single-head plug of the second embodiment.
Figure 9:
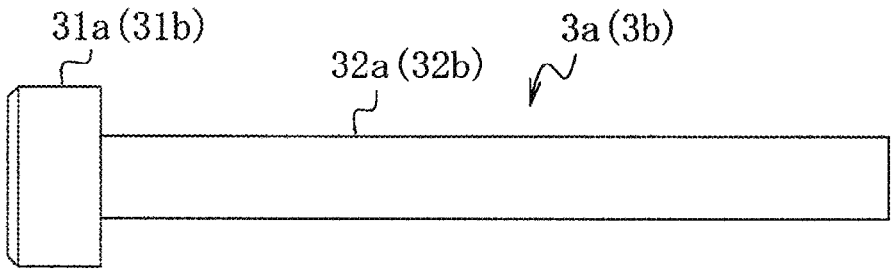
FIGS. 9(*a*) to 9(*c*) are explanatory views explaining attachment of an insulating collar and an insulating tube to a tubular electrode according to the second embodiment.
Figure 9:
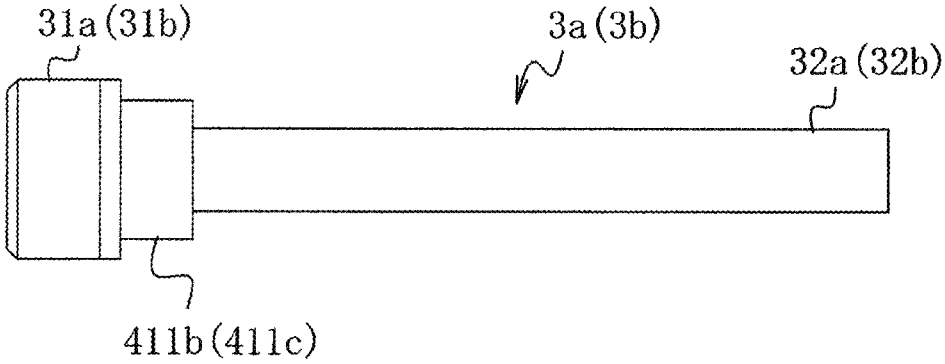
Figure 9:
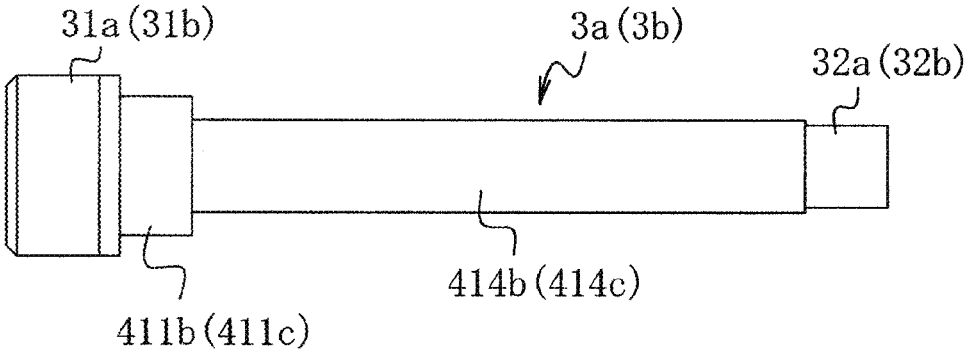

For manufacture of the multipolar single-head plug 5 of the second embodiment, as shown in FIG. 8, the bar electrode 2 and the tubular electrodes 3*a* to 3*d* each of a given shape are formed for example by cutting (S201) . Next, as shown in FIGS. 8 and 9, with flanges 4112*b* and 4112*c* facing forward, the insulating collars 411*b* and 411*c* are fitted into base parts 32*a* and 32*b* of the tubular electrodes 3*a* and 3*b* respectively from a side opposite conductive contact parts 31*a* and 31*b* of the tubular electrodes 3*a* and 3*b*. The insulating collars 411*b* and 411*c* are inserted until the flanges 4112*b* and 4112*c* of the insulating collars 411*b* and 411*c* come into abutting contact with respective side surfaces of the conductive contact parts 31*a* and 31*b* as exposed parts at corresponding outer circumferences (S202) . As an example, the insulating collars 411*b* and 411*c* can be made of the same material as that used in the first embodiment.

Next, as shown in FIGS. 8 and 9, the insulating tubes 414*b* and 414*c* are fitted into the base parts 32*a* and 32*b* of the tubular electrodes 3*a* and 3*b* respectively from a side opposite the conductive contact parts 31*a* and 31*b*. Then, respective tips of the insulating tubes 414*b* and 414*c* go into engagement with the cuts 4113*b* and 4113*c* of the insulating collars 411*b* and 411*c* respectively. Further, given areas of the outer circumferences of the tubular electrodes 3*a* and 3*b* are covered with the insulating tubes 414*b* and 414*c* respectively (S203). The insulating tubes 414*b* and 414*c* can be made of an appropriate insulating material such as polyamide resin, fluororesin, or polyether ether ketone (PEEK, registered trademark).

Next, as shown in FIG. 8, the bar electrode 2, the tubular electrodes 3*a* and 3*b* provided with the insulating tubes 414*b* and 414*c* and the insulating collars 411*b* and 411*c*, and the tubular electrodes 3*c* an 3*d* are placed in a mold (S204).

Then, the insulating resin is poured into the mold to perform insert molding. This forms the insulator 4 composed of the insulating parts 41*a* and 41*d*, and the insulating parts 41*b* and 41*c* with the insulating tubes 414*b* and 414*c* as separate insulating materials and the insulating resin tightly contacting the insulating tubes 414*b* and 414*c*. Then, the bar electrode 2, the multiple tubular electrodes 3*a* to 3*d*, and the insulator 4 are integrated (S205).

During this process, the insulating resin also flows into an entire gap between the bar electrode 2 and the tubular electrode 3*a* and into an entire gap between the tubular electrodes 3*c* and 3*d*, and is then cured. This forms the insulating parts 41*a* and 41*d* entirely made of the insulating resin for insert molding. The insulating resin further flows so as to tightly contact respective rear end surfaces of the insulating tubes 414*b* and 414*c* in engagement with the insulating collars 411*b* and 411*c* and is then cured, thereby forming the insulating parts 41*b* and 41*c*. Then, the bar electrode 2, the tubular electrodes 3*a* to 3*d*, the insulating collars 411*b* and 411*c*, and the insulating tubes 414*b* and 414*c* are integrated with the insulating resin for insert molding.

The multipolar single-head plug 5 or the method for manufacturing the same of the second embodiment has a structure corresponding to that of the first embodiment so it achieves effects corresponding to those achieved by the first embodiment. Additionally, using the insulating tubes 414*b* and 414*c* as separate insulating materials can place the separate insulating materials easily on electrode surfaces and can control the thickness of the separate insulating materials easily. Further, general-purpose tubes can be used as the separate insulating materials, making it possible to encourage reduction of manufacturing cost and efficient manufacturing process for the separate insulating materials.

[Modifications of Embodiments and Others]

In addition to the structure of each invention and that of each embodiment, the invention disclosed in this specification includes, within an applicable range, a structure specified by changing these partial structures to a different structure disclosed in this specification, a structure specified by adding a different structure disclosed in this specification to these structures, or a structure of a broader concept specified by deleting these partial structures to an extent by which action and effect of these structures can be achieved partially. The invention disclosed in this specification further encompasses modifications and others described below.

As an example, in the first and second embodiments, some of all the insulating parts 41*a* to 41*d:* the insulating parts 41*b* and 41*c,* are provided with the electrodeposition coating parts 412*b* and 412*c* or the insulating tubes 414*b* and 414*c* formed at their middle sections. The other insulating parts 41*a* and 41*d* are entirely made of the insulating resin for insert molding. Meanwhile, all the insulating parts 41*a* to 41*d* and the like forming the insulator 4 can be provided with separate insulating materials such as electrodeposition coating parts or insulating tubes formed at their middle sections. In this case, it is preferable that each of the separate insulating materials be made of a cylindrical insulating material and be responsive to a cylindrical narrow path extending axially between the bar electrode 2 and the tubular electrode 3*a,* between the tubular electrodes 3*a* and 3*b,* between the tubular electrodes 3*b* and 3*c,* or between the tubular electrodes 3*c* and 3*d.*

Hence, pouring of the insulating resin or favorable insulation will not be disturbed by eccentricity of an electrode due to increase of pressure applied during pouring of the insulating resin, so that a separate insulating material can reliably achieve insulation in a middle section in narrow space of each of the insulating parts 41*a* to 41*d* and the like. Thus, yield can be enhanced further.

A multipolar single-head plug with a separate insulating material provided to each of the insulating parts 41*a* to 41*d* is manufactured for example as follows. The bar electrode 2 and the tubular electrodes 3*a* to 3*d* each of a given shape are formed first. Before the bar electrode 2 and the tubular electrodes 3*a* to 3*d* are placed in a mold, separate insulating materials are provided in given areas of the respective outer circumferences of the bar electrode 2 and the tubular electrodes 3*a* to 3*c* by performing electrodeposition coating on these areas or by fitting insulating tubes to these areas. Next, an insulating collar is fitted onto each of the bar electrode 2 and the tubular electrodes 3*a* to 3*c.* Then, these electrodes are placed in the mold and are insert molded with the insulating resin, thereby forming the aforementioned multipolar single-head plug.

Where appropriate, a separate insulating material may be provided at least to any one of insulating parts of the insulator 4. As an example, a separate insulating material such as an electrodeposition coating part or an insulating tube can be provided so as to cover a given area of the outer circumference of the bar electrode 2 or so as to cover a given area of the outer circumference of an appropriate electrode such as the tubular electrode 3*a,* 3*b* or 3*c,* or it can be formed by an appropriate combination of these coverages.

A separate insulating material is not limited to an electrodeposition coating part or an insulating tube. Any separate insulating material is applicable which is provided so as to cover a given area of the outer circumference of the bar electrode 2 or that of one of the tubular electrodes 3*a* to 3*c,* for example, and which can tightly contact an insulating resin for insert molding. As an example, the separate insulating material can be an insulating tape part composed of a wound insulating tape that may be a polyimide tape such as Kapton (registered trademark) tapes. A multipolar single-head plug with this separate insulating material is manufactured for example as follows. An insulating material separate from an insulating resin for insert molding is provided so as to cover at least a given area of the outer circumference of the bar electrode 2 or a given area of the outer circumference of one of the tubular electrodes 3*a* to 3*c* and the like. Then, in the same way as mentioned above, a necessary insulating collar is fitted, and these electrodes are placed in a mold and insert molded with the insulating resin.

A multipolar single-head plug may not include an insulating collar. This multipolar single-head plug can be formed by pouring an insulating resin during insert molding to fill in a part corresponding to an insulating collar to provide insulating resin filled parts at a front section and a rear section of a separate insulating material such that the insulating resin filled parts tightly contact the separate insulating material. The multipolar single-head plug of this invention is not limited to the five-pole plug of the embodiments but it is further applicable to a multipolar single-head plug having a smaller number of poles such as two, three or four, or a multipolar single-head plug having a larger number of poles such as six, seven or eight. Additionally, one multipolar single-head plug can be provided with separate insulating materials of several types used in combination. As an example, an electrodeposition coating part and an insulating tube can be provided in one multipolar single-head plug.

A shape as viewed in the axial direction such as those of the bar electrode 2 and the tubular electrodes 3*a* to 3*d,* and those of the insulating parts 41*a* to 41*d* including the insulating collars 411*b* and 411*c* and the tubular parts 4111*b* and 4111*c* is not limited to a circle but it can be any appropriate shape such as an ellipse.

This invention is intended for a multipolar single-head plug comprising multiple curved electrodes provided separately at given positions of an outer circumference of the bar electrode 2 and exposed at the outer circumference on a side closer to a root than an exposed part of the bar electrode 2 at a tip thereof, and the insulator 4 composed of an insulating part between the bar electrode 2 and the curved electrode and an insulating part between the curved electrodes. The multipolar single-head plug is integrated with an insulating resin for insert molding that forms part of the insulator 4. A middle section of at least one of the insulating parts is provided with an insulating material separate from the insulating resin for insert molding. The separate insulating material is provided so as to cover at least a given area of the outer circumference of the bar electrode 2 or a given area of an outer circumference of one of the curved electrodes. As long as this multipolar single-head plug is assured, this invention encompasses an appropriate structure. In an example of such a structure, instead of the tubular electrodes 3*a* to 3*d,* arcuate electrodes arranged for example to be opposed to each other can be used as the curved electrodes, and a separate insulating material can be provided so as to cover given areas of outer circumferences of the arcuate electrodes.

INDUSTRIAL APPLICABILITY

This invention is applicable to a multipolar single-head plug to be used for electrical connection of various electronic devices such as multifunctional portable phones and potable music players.

REFERENCE SIGNS LIST

1, 5 Multipolar single-head plug
2 Bar electrode
21 Shaft part
22 Conductive contact part
23 Lead part
3*a* to 3*d* Tubular electrode
31*a* to 31*d* Conductive contact part
32*a* to 32*c* Base part
33*a* to 33*d* Lead part
32*d* Flange
4 Insulator
41*a* to 41*d* Insulating part
411*b*, 411*c* Insulating collar
4111*b*, 4111*c* Tubular part
4112*b*, 4112*c* Flange
4113*b*, 4113*c* Cut
412*b*, 412*c* Electrodeposition coating part
413*b*, 413*c* Insulating resin filled part
414*b*, 414*c* Insulating tube

The invention claimed is:

1. A multipolar single-head plug comprising:
a bar electrode exposed at a tip thereof;
multiple curved electrodes provided separately at given positions of an outer circumference of the bar electrode, the curved electrodes being exposed at the outer circumference on a side closer to a root than the exposed part of the bar electrode at the tip; and
an insulator composed of an insulating part between the bar electrode and the curved electrode and an insulating part between the curved electrodes, wherein
the multipolar single-head plug is integrated with an insulating resin for insert molding that forms part of the insulator,
at least one of the insulating parts is composed of a front section, a middle section, and a rear section, the middle section being separate from the front and rear sections and being provided with an insulating material separate from the insulating resin for insert molding, and
the separate insulating material is provided so as to cover at least a given area of the outer circumference of the bar electrode or a given area of an outer circumference of one of the curved electrodes.

2. The multipolar single-head plug according to claim 1, wherein the curved electrodes are tubular electrodes, and the tubular electrodes are concentrically arranged on the outer circumference of the bar electrode.

3. The multipolar single-head plug according to claim 2, wherein
the separate insulating material is an insulating material of a cylindrical shape, and
the separate insulating material of the cylindrical shape is provided to be responsive to a cylindrical narrow path extending axially between the bar electrode and the tubular electrode or between the tubular electrodes.

4. The multipolar single-head plug according to claim 2, wherein an insulating part having the middle section provided with the separate insulating material has a front section composed of an insulating collar.

5. The multipolar single-head plug according to claim 3, wherein an insulating part having the middle section provided with the separate insulating material has a front section composed of an insulating collar.

6. The multipolar single-head plug according to claim 4, wherein the separate insulating material and the insulating collar are provided so as to form engagement therebetween.

7. The multipolar single-head plug according to claim 5, wherein the separate insulating material and the insulating collar are provided so as to form engagement therebetween.

8. The multipolar single-head plug according to claim 1, wherein the separate insulating material is an electrodeposition coating part.

9. The multipolar single-head plug according to claim 5, wherein the separate insulating material is an electrodeposition coating part.

10. The multipolar single-head plug according to claim 1, wherein the separate insulating material is an insulating tube.

11. The multipolar single-head plug according to claim 5, wherein the separate insulating material is an insulating tube.

12. The multipolar single-head plug according to claim 2, wherein the insulator comprises:
an insulating part having the middle section provided with the separate insulating material; and
an insulating part entirely made of the insulating resin for insert molding.

13. The multipolar single-head plug according to claim 12, wherein multiple insulating parts have the middle sections provided with the separate insulating materials, the multiple insulating parts intervening between the insulating part between the bar electrode and the tubular electrode and the outermost insulating part between the tubular electrodes, the multiple insulating parts each intervening between the tubular electrodes.

14. The multipolar single-head plug according to claim 2, wherein each of the insulating parts forming the insulator has the middle section provided with the separate insulating material.

15. The multipolar single-head plug according to claim 1, wherein the separate insulating material has a thickness of from 0.008 to 0.15 mm.

16. A method for manufacturing a multipolar single-head plug, the multipolar single-head plug comprising:
a bar electrode exposed at a tip thereof;
multiple tubular electrodes concentrically arranged on an outer circumference of the bar electrode and exposed at the outer circumference on a side closer to a root than the exposed part of the bar electrode at the tip; and
an insulator composed of an insulating part between the bar electrode and the tubular electrode and an insulating part between the tubular electrodes,
the multipolar single-head plug being integrated with an insulating resin for insert molding that forms part of the insulator,
the method comprising:
a first step of providing an insulating material so as to cover at least a given area of the outer circumference of the bar electrode or a given area of an outer circumference of one of the tubular electrodes, the insulating material being provided to a middle section of at least one of the insulating parts composed of a front section, the middle section, and a rear section, the middle section being separate from the front and rear sections, the insulating material being separate from the insulating resin for insert molding;
a second step of placing the bar electrode and the multiple tubular electrodes in a mold; and
a third step of forming the insulator including an insulating part with the insulating resin tightly contacting the separate insulating material by pouring the insulating resin into the mold, thereby integrating the bar electrode, the multiple tubular electrodes, and the insulator.

17. The method for manufacturing the multipolar single-head plug according to claim 16, wherein the first step includes a step of forming an electrodeposition coating part as the separate insulating material by performing electrodeposition coating so as to cover at least a given area of an outer circumference of one of the tubular electrodes, and the first step includes a step of fitting an insulating collar so as to form abutting contact with a side surface of an exposed part at the outer circumference of the tubular electrode provided with the electrodeposition coating part.

18. The method for manufacturing the multipolar single-head plug according to claim 16, wherein the first step includes a step of fitting an insulating collar so as to form abutting contact with a side surface of an exposed part at an outer circumference of at least one of the tubular electrodes, and the first step includes a step of fitting an insulating tube so as to form engagement with the insulating collar and so as to cover a given area of the outer circumference of the tubular electrode.

19. An electronic device comprising the multipolar single-head plug as recited in claim 1.

* * * * *